US008829400B2

(12) United States Patent
Yasumuro et al.

(10) Patent No.: US 8,829,400 B2
(45) Date of Patent: Sep. 9, 2014

(54) PACKAGING CONTAINER FOR COOKING BY ELECTRONIC OVEN

(75) Inventors: Hisakazu Yasumuro, Kanagawa (JP); Keizou Kanzaki, Kanagawa (JP); Shie Nishimoto, Kanagawa (JP); Hiroshi Akitoshi, Kanagawa (JP); Kikuo Matsuoka, Kanagawa (JP)

(73) Assignee: Toyo Seikan Kaisha, Ltd., Tokyo (JP)

( * ) Notice: Subject to any disclaimer, the term of this patent is extended or adjusted under 35 U.S.C. 154(b) by 1641 days.

(21) Appl. No.: 12/063,705

(22) PCT Filed: Aug. 9, 2006

(86) PCT No.: PCT/JP2006/315748

§ 371 (c)(1),
(2), (4) Date: May 2, 2008

(87) PCT Pub. No.: WO2007/020854

PCT Pub. Date: Feb. 22, 2007

(65) Prior Publication Data

US 2009/0145895 A1 Jun. 11, 2009

(30) Foreign Application Priority Data

Aug. 16, 2005 (JP) ..... 2005-236004

(51) Int. Cl.

| | |
|---|---|
| ***H05B 6/80*** | (2006.01) |
| ***B65D 30/26*** | (2006.01) |
| ***B65D 51/16*** | (2006.01) |
| ***B65D 77/22*** | (2006.01) |
| ***B65D 81/34*** | (2006.01) |

(52) U.S. Cl.

CPC ..... *B65D 81/343* (2013.01); *B65D 51/1638* (2013.01); *B65D 77/225* (2013.01)

USPC ..... 219/730; 219/728; 426/113; 386/103

(58) Field of Classification Search

CPC . B65D 51/1638; B65D 81/343; B65D 77/225

USPC ..... 219/730, 725, 728, 745, 734, 759; 383/103, 202, 210, 211; 426/107, 113, 426/234, 241–243, 111, 118, 412; 428/34.2, 34.3, 195.1, 35.2, 35.7, 216, 428/457, 606

See application file for complete search history.

(56) References Cited

U.S. PATENT DOCUMENTS

| | | | | |
|---|---|---|---|---|
| 5,587,192 | A * | 12/1996 | Beizermann | 426/118 |
| 6,182,850 | B1 | 2/2001 | Marbler et al. | |
| 2007/0023425 | A1 | 2/2007 | Kanzaki et al. | |

FOREIGN PATENT DOCUMENTS

| | | |
|---|---|---|
| EP | 1 122 189 A1 | 8/2001 |
| EP | 1 422 163 A1 | 5/2004 |

(Continued)

*Primary Examiner* — Quang Van

(74) *Attorney, Agent, or Firm* — Sughrue Mion, PLLC

(57) ABSTRACT

A packaging container which includes a synthetic resin container body having a flange part and the cover member heat-sealed to the flange part of the container body. The cover member includes (1) an upper member in which inner surfaces of resin films are positioned opposite to each other to form an abutted part, an unsealed part communicating with the inside of the container body is formed by heat-sealing a peripheral edge part of the abutted part excluding one side of the abutted part forming a base part, and the steam releasing seal part is formed at the abutted part and (2) a lower member which covers a lower surface of the upper member and in which a steam guide part communicating with the inside of the container body is formed at or near the base part of the abutted part.

12 Claims, 7 Drawing Sheets

(56) References Cited

FOREIGN PATENT DOCUMENTS

| | | | |
|---|---|---|---|
| JP | 2000-153885 | A | 6/2000 |
| JP | 2002-80072 | A | 3/2002 |
| JP | 200381360 | | 3/2003 |
| JP | 2003-200979 | A | 7/2003 |
| JP | 2005-35568 | A | 2/2005 |
| JP | 2005-75426 | A | 3/2005 |
| WO | 99/61346 | A1 | 12/1999 |
| WO | 2004/048225 | A1 | 6/2004 |

* cited by examiner

PACKAGING CONTAINER FOR COOKING BY ELECTRONIC OVEN

CROSS REFERENCE TO RELATED APPLICATIONS

This application is a National Stage of International Application No. PCT/JP2006/315748 filed on Aug. 9, 2006, claiming priority based on Japanese Patent Application No. 2005-236004, filed on Aug. 16, 2005, the contents of all of which are incorporated herein by reference in their entirety.

TECHNICAL FIELD

The present invention relates to a packaging container for cooking by an electronic oven, which is used to contain retort food, frozen food or the like and heated in an electronic oven for cooking.

BACKGROUND ART

Hitherto, there have been known various synthetic resin packaging containers for cooking by an electronic oven, which are sealed up after they contain retort food, and frozen food or the like, and heated in an electronic oven for cooking at the time of eating. However, when the packaging container is heated in an electronic oven, an inside pressure of the packaging container is increased by steam and the like generated from the food contained therein, the packaging container explodes, and the food is scattered. As a result, an inside of the electronic oven becomes a mess and harm such as a scald may be inflicted on a human body.

Therefore, before the above packaging container is heated in the electronic oven, it is partially unsealed or a hole is produced in the packaging container to discharge steam and the like, generated in the packaging container to an outside thereof so as to prevent the explosion of the packaging container.

However, this takes time and labor for an ordinary consumer. Since steam generated by heating in the electronic oven is discharged to the outside of the packaging container immediately, the packaging container has a disadvantage in that the effect of heating and steaming the contents of the container by steam lowers and the taste of the contents becomes worse.

To eliminate the disadvantage described above, there is proposed a packaging container having a back bonded part or a sealing fin which projects from a cover member to be bonded to a container body and is arranged across the cover member, and a release part or a weakly sealed part is formed in this projecting part (see Patent Documents 1 and 2, for example).

Patent Document 1: JP-A-2000-153885

Patent Document 2: JP-A-2003-200979

However, the packaging containers disclosed in these patent documents are containers in which a resin film constituting the cover member is lifted up to project from the top surface (side opposite to the container body) of the cover member to form the back bonded part or sealing fin, and this cover member is directly bonded to the body of the packaging container. Therefore, a space is formed between the base part (mating part) of the projecting part which is the back bonded part or sealing fin of the cover member and the container body, thereby causing imperfect sealing between the cover member and the container body at this position. As a result, there arises a problem in that a leak of the contents occurs during the distribution of the packaging container which contains the contents hermetically or during heating of the packaging container in the electronic oven for cooking.

DISCLOSURE OF THE INVENTION

Problem to be Solved by the Invention

Therefore, an object of the present invention is to provide a packaging container for cooking by an electronic oven which has high sealability between a container body and a cover member, and is capable of being automatically and securely opened from a steam releasing seal part after taste of contents is improved by a steaming effect by maintaining inside pressure of the packaging container for a specified time when the contents are heated and cooked by the electronic oven.

Means for Solving the Problem

The inventors of the present invention have conducted intensive studies and found that the above object can be attained by a packaging container for cooking by an electronic oven, including a cover member which is formed of (1) an upper member provided with a steam releasing seal part in an abutted part and (2) a lower member which covers the under surface of the upper member and has a steam guide part communicating with the inside of the container body at or near the base part of the abutted part. The present invention has been accomplished based on this finding.

That is, the present invention adopts the following constitutions 1 to 11.

1. A packaging container for cooking by an electronic oven, comprising: a container body having a flange part and made of a synthetic resin; and a cover member which is heat-sealed to the flange part of the container body, the cover member comprising:

(1) an upper member in which inner surfaces of resin films are opposed to each other to form an abutted part, an unsealed part communicating with an inside of the container body is formed by heat-sealing a peripheral part of the abutted part excluding one side forming a base part of the abutted part, and a steam releasing seal part is formed in the abutted part; and (2) a lower member which covers an under surface of the upper member and has a steam guide part communicating with the inside of the container body at or near the base part of the abutted part.

2. A packaging container for cooking by an electronic oven according to item 1, in which the resin film constituting the upper member of the cover member is composed of a multilayer film including at least an inner resin layer having heat sealability and an outer resin layer.

3. A packaging container for cooking by an electronic oven according to item 1 or 2, in which the lower member of the cover member covers the whole under surface of the upper member of the cover member.

4. A packaging container for cooking by an electronic oven according to any one of items 1 to 3, in which the upper member and lower member constituting the cover member are heat-sealed along the full length in the width direction of the cover member at other positions than the steam guide part.

5. A packaging container for cooking by an electronic oven according to any one of items 1 to 4, in which the upper member of the cover member is formed by bending the end parts of two resin films, abutting the bent parts against each other, and heat-sealing the peripheral part of the abutted part.

6. A packaging container for cooking by an electronic oven according to any one of items 1 to 4, in which the upper member of the cover member is formed by folding one resin film to form a mountain part and heat-sealing a peripheral part of the mountain part.

7. A packaging container for cooking by an electronic oven according to any one of items 1 to 6, in which the steam releasing seal part is formed by projecting a top heat seal part of the abutted part formed in the upper member of the cover member toward the inside of the abutted part.

8. A packaging container for cooking by an electronic oven according to any one of items 1 to 6, in which the steam releasing seal part is formed by forming a notch extending toward the inside of the abutted part at a top edge of the abutted part formed in the upper member of the cover member and heat-sealing a peripheral part of the notch.

9. A packaging container for cooking by an electronic oven according to any one of items 1 to 6, in which the steam releasing seal part is formed by forming a heat seal part having a weak part in the abutted part at a position separate from the top edge heat seal part of the abutted part formed in the upper member of the cover member.

10. A packaging container for cooking by an electronic oven according to item 9, in which the steam releasing seal part is composed of an annular outer seal part, an unsealed part formed on the inner side of the outer seal part and a weak part configured with a through hole or a slit formed in the unsealed part.

11. A packaging container for cooking by an electronic oven according to any one of items 1 to 10, in which a top surface of the container body and the cover member are each made in a square shape, when the length from one inner end of the top surface of the container body to the base part of the abutted part of the cover member is represented by A, and the distance between the base part of the abutted part and the other inner end of the top surface of the container body is represented by B, A/B is 0.1 to 0.8.

Effects of the Invention

By employing the above constitution, the present invention provides the following effects.

(1) Sealability between the body and the cover member of the packaging container is so high that the contents do not leak out during the manufacture or distribution of the container or during heating thereof in an electronic oven.

(2) The cooking time of the contents is shortened by a steaming effect by increasing the inside pressure of the packaging container to a certain level and maintaining the pressure for a specified time when the contents are heated and cooked by the electronic oven, thereby making it possible to improve the taste of the contents.

(3) When the inside pressure of the packaging container becomes a certain level or more, the packaging container is automatically and securely opened from a steam releasing seal part, thereby making it possible to prevent the explosion or deformation of the container.

(4) A special process or member is not required and the packaging container can be manufactured at low cost.

DESCRIPTION OF SYMBOLS

Figure 1:
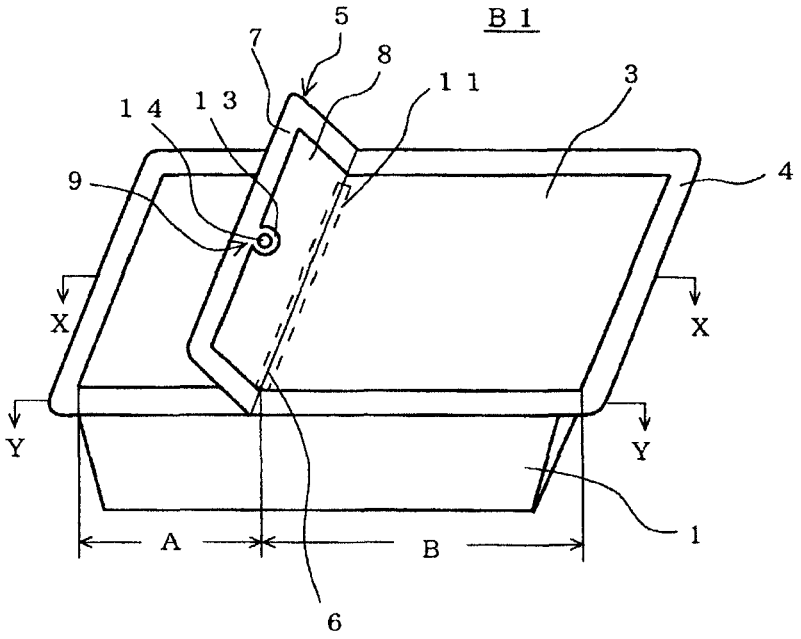
FIG. 1 A diagram showing an example of the packaging container for cooking by an electronic oven of the present invention.

B1, B2, B3, B4 box-type packaging container
C1, C2 cup-type container
1 container body
2 flange part
3, 31 cover member
4, 7 peripheral seal part
5, 51 abutted part
6 base part of abutted part
8, 18 unsealed part
8' space
9, 19, 29 steam releasing seal part
10 upper member of cover member
11 steam guide part
12 lower member of cover member
13 outer seal part
14 through hole
15 heat seal part
21 inner resin layer
22 outer resin layer
28 notch

BEST MODE FOR CARRYING OUT THE INVENTION

As the material constituting the container body and cover member of the package for cooking by an electronic oven of the present invention, a plastic material having heat sealability which is generally used for the manufacture of a packaging container is used. The plastic material is, for example, a single-layer film or sheet made of a thermoplastic resin having heat sealability, and a multi-layer film or sheet made of a thermoplastic resin having heat sealability and another thermoplastic resin.

Examples of the plastic material having heat sealability include olefin-based resins such as known low-density polyethylene, linear low-density polyethylene, medium-density polyethylene, high-density polyethylene, polypropylene, propylene-ethylene copolymer, ethylene-vinyl acetate copolymer and olefin resins graft-modified by an ethylene-based unsaturated carboxylic acid or anhydride thereof; polyamide and copolyamide resins having a relatively low melting point or a low softening point; polyester and copolyester resins; and polycarbonate resins.

Examples of the another plastic material to be laminated with the plastic material having heat sealability include thermoplastic resins having or not having heat sealability, various barrier films and oxygen absorbing resins.

Examples of such a thermoplastic resin include: polyolefins such as crystalline polypropylene, a crystalline propylene/ethylene copolymer, crystalline polybutene-1, crystalline poly4-methylpentene-1, low-, medium-, or high-density polyethylene, an ethylene/vinyl acetate copolymer (EVA), an EVA saponified product, an ethylene/ethyl acrylate copolymer (EEA), and an ion crosslinked olefin copolymer (ionomer); an aromatic vinyl copolymer such as polystyrene or a styrene/butadiene copolymer; a halogenated vinyl polymer such as polyvinyl chloride or a vinylidene chloride resin; a polyacrylic resin; a nitrile polymer such as an acrylonitrile/styrene copolymer or an acrylonitrile/styrene/butadiene copolymer; polyesters such as polyethylene terephthalate and polytetramethylene terephthalate; a polyamide such as 6-nylon, 12-nylon, and metaxylene diamine (MX) nylon; various polycarbonates; a fluorine-based resin; and polyacetals such as polyoxymethylene. One kind of thermoplastic resin may be used alone, or two or more kinds thereof may be blended and used. Further, the thermoplastic resin may be used by mixing various additives.

All films made of a known thermoplastic resin having oxygen barrier properties may be used as the barrier films. Examples of the resin include ethylene-vinyl alcohol copolymers, polyamides, polyvinylidene chloride-based resins, polyvinyl alcohols and fluororesins. A resin not containing chlorine, which may not generate harmful gas, when the resin is burnt, is preferably used.

The particularly preferred oxygen barrier resin is a copolymer saponified product obtained by saponifying an ethylene-vinylacetate copolymer having an ethylene content of 20 to 60 mol %, specifically 25 to 50 mol % to a saponification degree of 96 mol % or more, specifically 99 mol % or more.

Other preferred oxygen barrier resins include polyamides having 5 to 50 amido groups, specifically 6 to 20 amido groups based on 100 carbon atoms such as nylon 6, nylon 6,6, nylon 6/6,6 copolymer, metaxylylene adipamide (MX6), nylon 6,10, nylon 11, nylon 12, and nylon 13.

Examples of other barrier films include: a silica vapor deposited polyester film, an alumina vapor deposited polyester film, a silica vapor deposited nylon film, an alumina vapor deposited nylon film, an alumina vapor deposited polypropylene film, a carbon vapor deposited polyester film, a carbon vapor deposited nylon film; a co-vapor deposited film prepared through co-vapor deposition of alumina and silica on a base film such as a polyester film or a nylon film; a co-extruded film such as a nylon 6/metaxylene diamine nylon 6 co-extruded film or a propylene/ethylene vinyl alcohol copolymer co-extruded film; an organic resin-coated film such as a polyvinyl alcohol-coated polypropylene film, a polyvinyl alcohol-coated polyester film, a polyvinyl alcohol-coated nylon film, a polyacrylic resin-coated polyester film, a polyacrylic resin-coated nylon film, a polyacrylic resin-coated polypropylene film, a polyglycolic acid resin-coated polyester film, a polyglycolic acid resin-coated nylon film, or a polyglycolic acid resin-coated polypropylene film; and a film prepared by coating a hybrid coating material formed of an organic resin material and an inorganic material on a base film such as a polyester film, a nylon film, or a polypropylene film. One kind of barrier film may be used alone, or two or more kinds thereof may be used in combination.

A resin having an oxygen absorbable property may employ (1) a resin having oxygen absorbing property itself or (2) a resin composition containing an oxygen absorber in a thermoplastic resin having or not having oxygen absorbing property. The thermoplastic resin used for forming the oxygen absorbable resin composition (2) is not particularly limited, and a thermoplastic resin having oxygen barrier property or a thermoplastic resin having no oxygen barrier property may be used. Use of a resin having oxygen absorbing property or oxygen barrier property itself for the thermoplastic resin used for forming the resin composition (2) is preferred because intrusion of oxygen into the container may be effectively prevented by combination with an oxygen absorbing effect of the oxygen absorber.

An example of the resin having oxygen absorbing property itself is a resin utilizing an oxidation reaction of the resin. Examples of such a material include an oxidative organic material such as polybutadiene, polyisoprene, polypropylene, an ethylene/carbon monoxide copolymer, or polyamides such as 6-nylon, 12-nylon, or metaxylene diamine (MX) nylon having organic acid salts each containing a transition metal such as cobalt, rhodium, or copper as an oxidation catalyst or a photosensitizer such as benzophenone, acetophenone, or chloroketones added. In the case where the oxygen absorbing material is used, high energy rays such as UV rays or electron rays may be emitted, to thereby develop further oxygen absorbing effects.

Any oxygen absorbers conventionally used for such applications can be used as an oxygen absorber to be mixed into a thermoplastic resin. A preferred oxygen absorber is generally reductive and substantially insoluble in water. Appropriate examples thereof include: metal powder having reducing power such as reductive iron, reductive zinc, or reductive tin powder; a lower metal oxide such as FeO or $Fe_3O_4$; and a reductive metal compound containing as a main component one or two or more kinds of iron carbide, ferrosilicon, iron carbonyl, and iron hydroxide in combination. An example of a particularly preferred oxygen absorber is reductive iron such as reductive iron obtained by reducing iron oxide obtained in a production process of steel, pulverizing produced sponge iron, and conducting finish reduction in a hydrogen gas or a decomposed ammonia gas. Another example thereof is reductive iron obtained by electrolytically depositing iron from an aqueous solution of iron chloride obtained in a pickling step during steel production, pulverizing the resultant, and conducting finish reduction.

As required, the oxygen absorber may be used in combination with: an oxidation accelerator formed of an electrolyte such as a hydroxide, carbonate, sulfite, thiosulfate, tribasic phosphate, dibasic phosphate, organic acid salt, or halide of an alkali metal or alkali earth metal; and an assistant such as active carbon, active alumina, or active clay. Particularly preferred examples of the oxygen accelerator include sodium chloride, calcium chloride, and a combination thereof.

In the case where reductive iron and the oxidation accelerator are used in combination, a mixing amount thereof is preferably 99 to 80 parts by weight of reductive iron and 1 to 20 parts by weight of oxidation accelerator, in particular, 98 to 90 parts by weight of reductive iron and 2 to 10 parts by weight of oxidation accelerator with respect to 100 parts by weight in total.

Another example of the oxygen absorber is a polymer compound having a polyhydric phenol in a skeleton such as a phenol/aldehyde resin having a polyhydric phenol. Further, ascorbic acid, erysorbic acid, tocophenols, and salts thereof which are water-soluble substances may appropriately be used. Of oxygen absorbable substances, reductive iron and an ascorbic acid-based compound are particularly preferred.

Further, a thermoplastic resin may contain the resin having oxygen absorbing property itself as an oxygen absorber.

The oxygen absorber preferably has an average particle size of generally 50 μm or less, and particularly preferably 30 μm or less. In the case where the packaging container requires transparency or translucency, an oxygen absorber having an average particle size of preferably 10 μm or less, and particularly preferably 5 μm or less is used. The oxygen absorber is preferably mixed into the resin in a ratio of preferably 1 to 70 wt %, and particularly preferably 5 to 30 wt %.

In the present invention, as the material constituting the container body and the cover member, a laminate having a multi-layer structure including various barrier films and an oxygen absorbing resin layer is preferably used. An adhesive layer may be optionally interposed between layers constituting the laminate. The adhesive is not particularly limited and is, for example, a polyolefin-based adhesive modified by an acid anhydride such as maleic anhydride, polyurethane-based adhesive or an adhesive which is used as an adhesive for laminates.

The preferred layer structure of the laminate constituting the container body includes: polypropylene (PP), an adhesive, a gas barrier resin such as a saponified product of an ethylene-vinyl acetate copolymer (EVOH), an adhesive, and PP; and PP, an adhesive, EVOH, an adhesive, oxygen absorbing resin layer (for example, polyolefin containing reducing iron and an oxidation accelerator), and PP; in the order from the exterior side of the container.

The preferred layer structure of the laminate constituting the cover member includes: nylon (NY), EVOH, and PP/polyethylene (PE)-based composite material; NY, EVOH, and linear low-density polyethylene (LLDPE); vapor deposited polyethylene terephthalate (PET), NY, and PP/PE-based composite material; vapor deposited PET, NY, and LLDPE; and vapor deposited PET, NY, and polybutylene terephthalate (PBT)-based resin; from the exterior side of the cover member.

Subsequently, the packaging container for cooking by an electronic oven of the present invention will be described with reference to the drawings.

Figure 2:
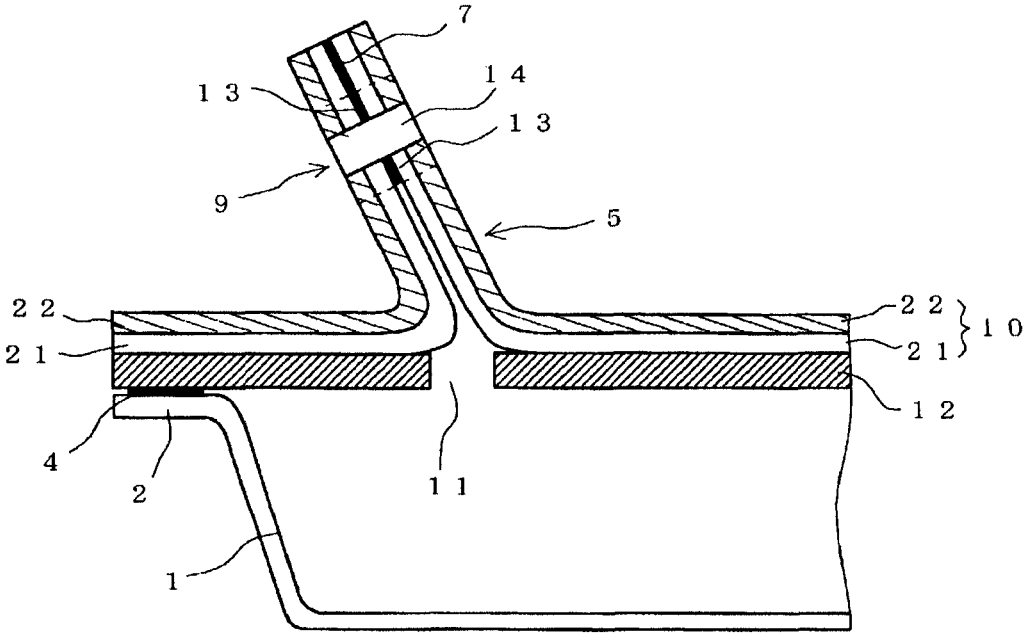
FIG. 2 A schematic diagram showing the state of the section on line XX of the packaging container shown in FIG. 1.
Figure 3:
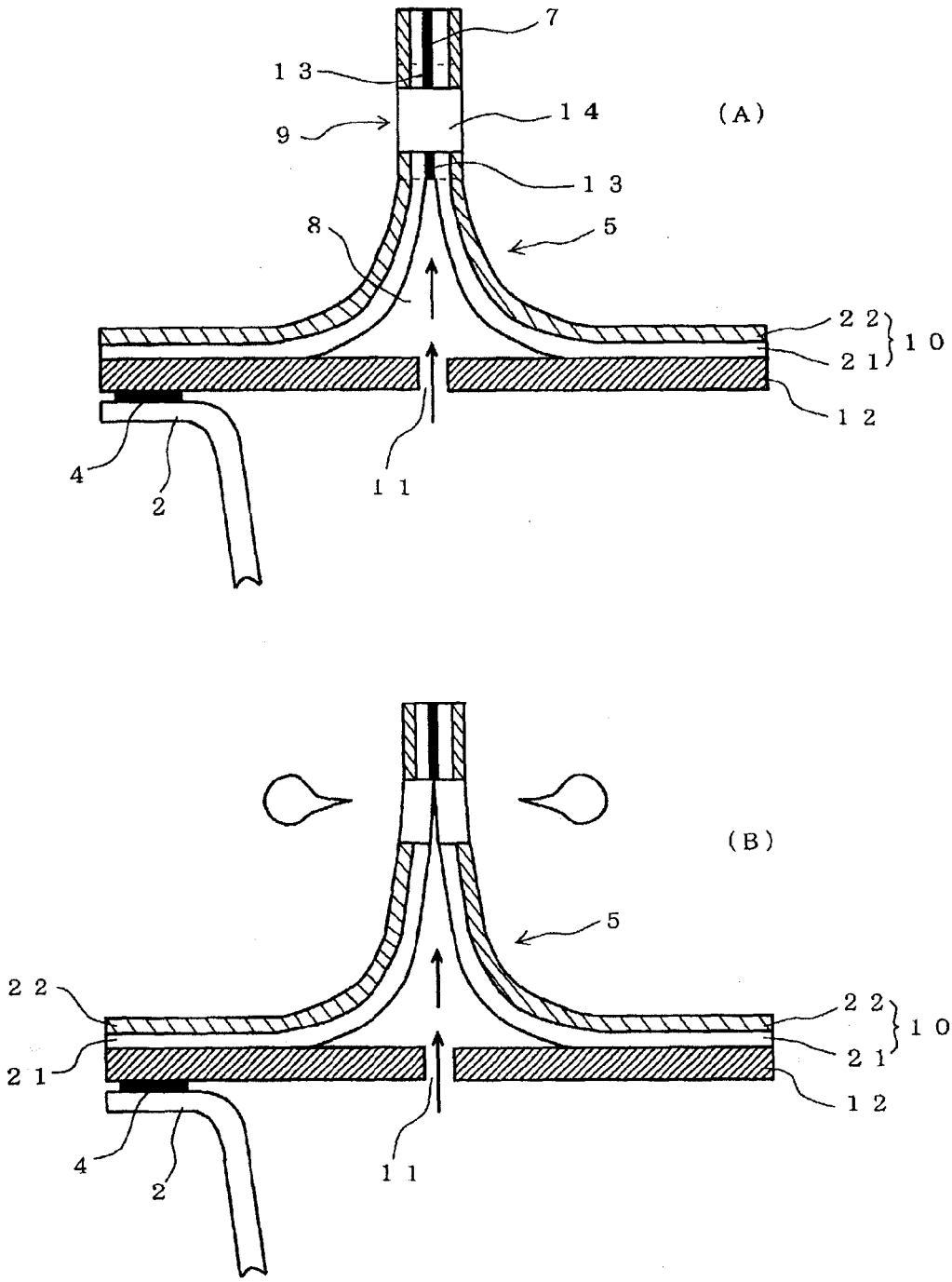
FIG. 3 Schematic diagrams showing states of the part shown in FIG. 2 when the packaging container shown in FIG. 1 is heated in an electronic oven.
Figure 4:
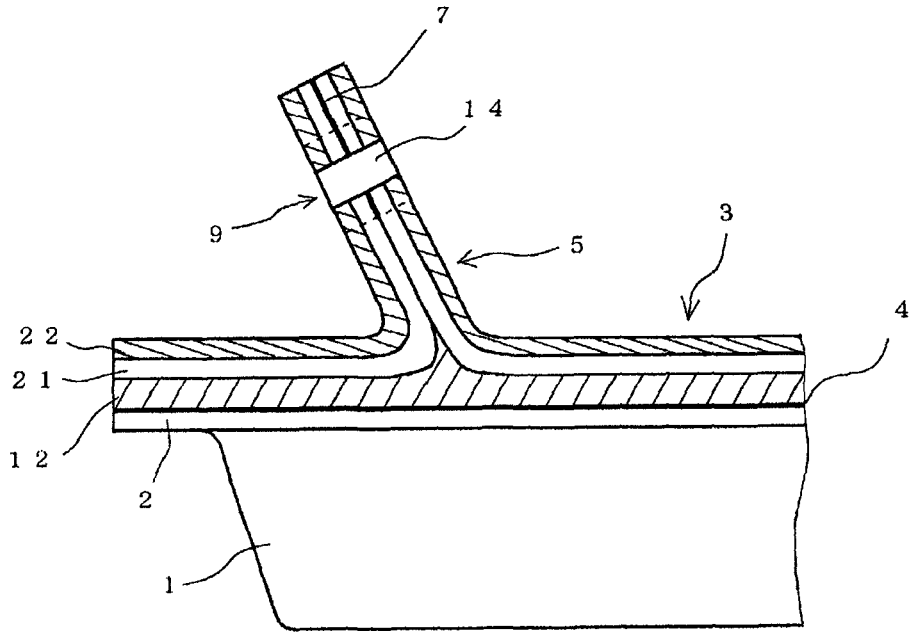
FIG. 4 A schematic diagram showing the state of the section on line YY of the packaging container shown in FIG. 1.

FIGS. 1 to 4 show an example of the packaging container for cooking by an electronic oven of the present invention. FIG. 1 is a perspective view of the packaging container and FIG. 2 is a partially enlarged schematic diagram showing the state of the section of the packaging container on line XX of FIG. 1. FIGS. 3(A) and 3(B) are schematic diagrams showing the state of the part of FIG. 2 when the packaging container is heated in an electronic oven. FIG. 3(A) shows the state before a steam releasing seal part is opened and FIG. 3(B) shows the state after the steam releasing seal part was opened. FIG. 4 is a schematic diagram showing the state of the section of the packaging container on line YY (peripheral seal part of a flange part) of FIG. 1.

The packaging container B1 is formed of a square container body 1 having a flange part 2 and a cover member 3 heat-sealed to the flange part 2 of the container body 1 at a peripheral seal part 4. The cover member 3 is formed of an upper member 10 composed of a multi-layer film including an inner resin layer 21 made of a resin having heat sealability and an outer resin layer 22 and a lower member 12 covering the whole under surface of the upper member 10.

An abutted part 5 is formed in the upper member 10 by opposing the inner resin layers 21 of the multi-layer film to each other. A peripheral seal part 7 is formed by heat-sealing the peripheral part of the abutted part 5 excluding one side which becomes a base part 6 of the abutted part 5 to thereby form an unsealed part 8 communicating with the inside of the container body 1. A steam releasing seal part 9 having a through hole 14 in an annular outer seal part 13 is formed continuous with the top peripheral seal part 7 of the abutted part 5.

A groove-like steam guide part 11 is formed along the base part 6 below the base part 6 of the abutted part 5 of the upper member 10 in the lower member 12 which covers the whole under surface of the cover member 3 so that the unsealed part 8 of the abutted part 5 communicates with the inside of the container body 1.

The packaging container B1 is filled with contents such as sterile rice, retort food, or frozen food, and the peripheral part 4 of the lower member 12 of the cover member 3 is heat-sealed to the flange part 2 of the container body 1 to form the peripheral seal part 4, thereby sealing up the packaging container B1.

When the packaging container B1 filled with the contents and sealed up is heated in an electronic oven, as shown in FIG. 3(A), steam or the like generated from the contents passes through the steam guide part 11 of the lower member 12 of the cover member 3 and enters the unsealed part 8 of the abutted part 5. The steam or the like swells the unsealed part 8, stress is concentrated on the steam releasing seal part 9 (the arrows in FIG. 3(A)), and the separation of the outer seal part 13 starts from the end on the unsealed part 8 side of the outer seal part 13 of the steam releasing seal part 9.

As the inside pressure of the container rises, the outer seal part 13 separates and backs away. When the separation reaches the through hole 14, the steam releasing seal part 9 opens and steam or the like is discharged to the outside, thereby completing the heating and cooking of the contents (see FIG. 3(B)).

In the packaging container B1, the cover member 3 is formed of the upper member 10 and the lower member 12 which covers the whole under surface of the upper member 10. As a result, when the peripheral part of the cover member 3 is heat-sealed to the flange part 2 of the container body 1 to form the peripheral seal part 4, as shown in FIG. 4, the flange part 2 is heat-sealed to the flat lower member 12 so that a perfect sealing is performed. Therefore, a leak of the contents does not occur when the packaging container is filled with the contents and sealed up and during the distribution of the packaging container.

Figure 5:
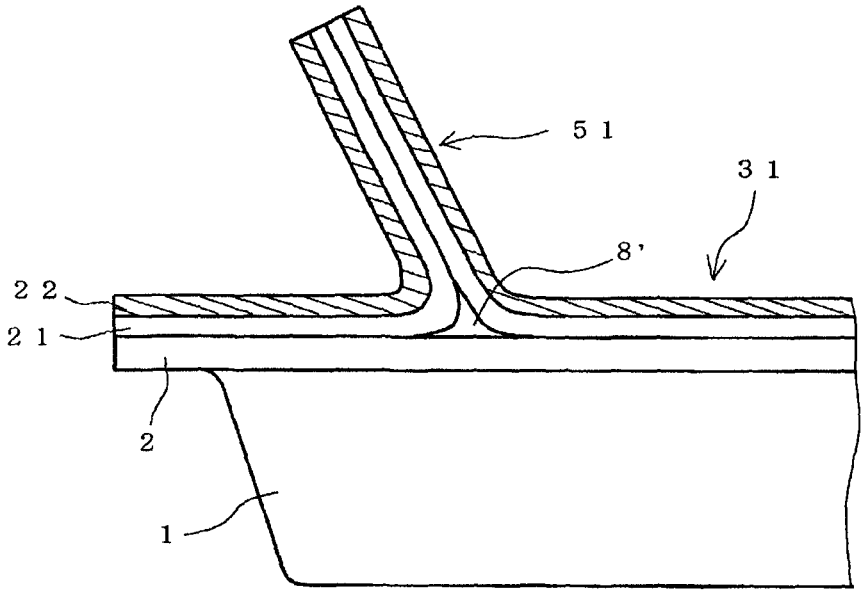
FIG. 5 A schematic diagram showing the sealing state between the cover member and flange part of a conventional packaging container.

Meanwhile, in the packaging containers disclosed by the above Patent Documents 1 and 2, as shown in FIG. 5, while a space 8' formed in the base part of a back bonded part or sealing fin 51 remains as it is, the inner resin layer 21 of a laminated film constituting a cover member 31 is directly heat-sealed to a flange part 2. Therefore, sealing between the cover member 31 and the flange part 2 becomes imperfect at this position, whereby a leak of the contents occurs during the manufacture or distribution of the packaging container filled with contents and sealed up or during heating and cooking by an electronic oven.

In the packaging container of the present invention, when the upper member 10 and the lower member 12 constituting the cover member 3 are heat-sealed to each other, the lower member 12 is molten and filled into the base part of the abutted part 5, thereby forming no space. In contrast to this, in the packaging containers disclosed by the Patent Documents 1 and 2, the flange part 2 to be heat-sealed to the cover member 31 is more unlikely to melt than the lower member 12 of the packaging container of the present invention, thereby forming the space 8' in the base part of the abutted part 5.

Figure 6:
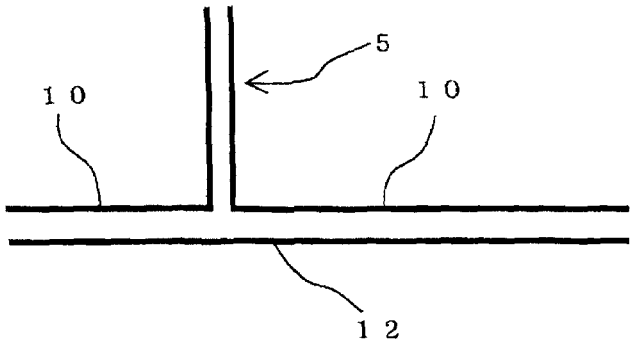
FIG. 6 A schematic diagram describing an example of the process of manufacturing the cover member of the packaging container for cooking by an electronic oven of the present invention.

To manufacture the cover member of the packaging container of the present invention, as shown in FIG. 6, the abutted part 5 of the upper member of the cover member is formed by bending the end parts of two resin films 10 and 10 and abutting the bent parts against each other. The unsealed part 8 is formed by heat-sealing the peripheral part of the abutted part 5 excluding one side which becomes the base part of the abutted part 5, and the lower member 12 having the steam guide part 11 is laminated on the under surface of the upper member 10.

Figure 7:
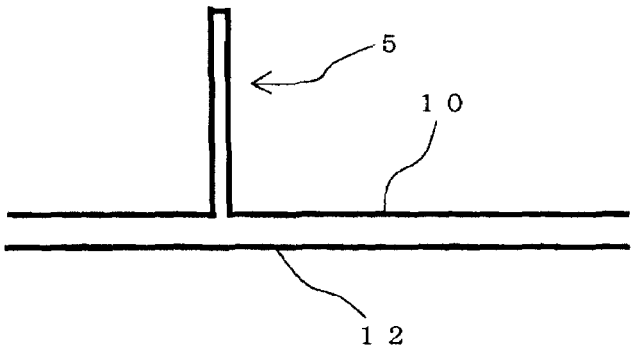
FIG. 7 A schematic diagram describing another example of the process of manufacturing the cover member of the packaging container for cooking by an electronic oven of the present invention.

Alternatively, as shown in FIG. 7, the abutted part 5 of the upper member 10 of the cover member is formed by folding one resin film to form a mountain part and heat-sealing the peripheral part of the mountain part excluding one side which becomes the base part of the mountain part. The cover member may be manufactured by laminating the lower member 12 on the under surface of the upper member 10.

It is needless to say that a multi-layer film including one or more intermediate resin layers between the inner resin layer 21 and the outer resin layer 22 may be used as the multi-layer film constituting the upper member 10.

Figure 8:
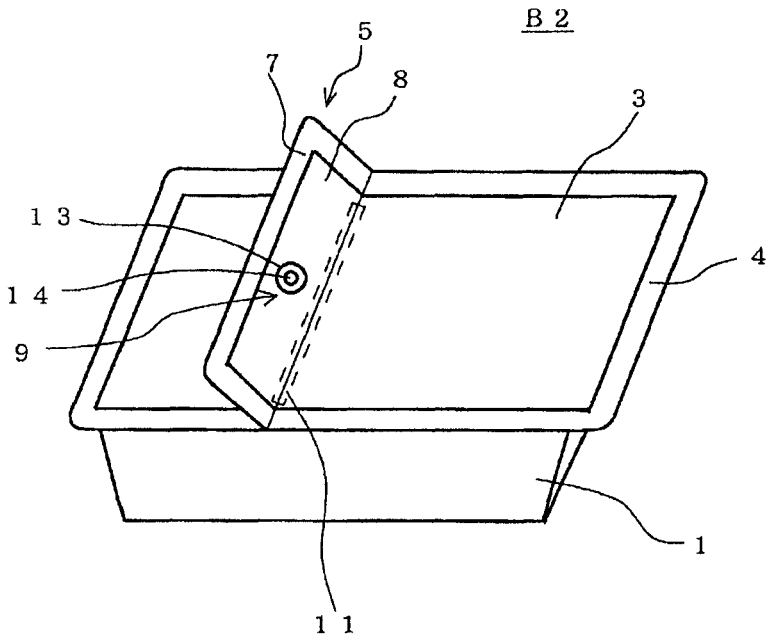
FIG. 8 A diagram showing another example of the packaging container for cooking by an electronic oven of the present invention.

FIG. 8 shows another example of the packaging container for cooking by an electronic oven of the present invention.

The packaging container B2 differs from the packaging container B1 shown in FIGS. 1 to 4 in that the steam releasing seal part 9 having the through hole 14 in the annular outer seal part 13 to be formed in the abutted part 5 of the cover member 3 is arranged at a position separate from the peripheral seal part 7. The other constitution of the packaging container B2 is the same as that of the packaging container B1 shown in FIGS. 1 to 4.

Figure 9:
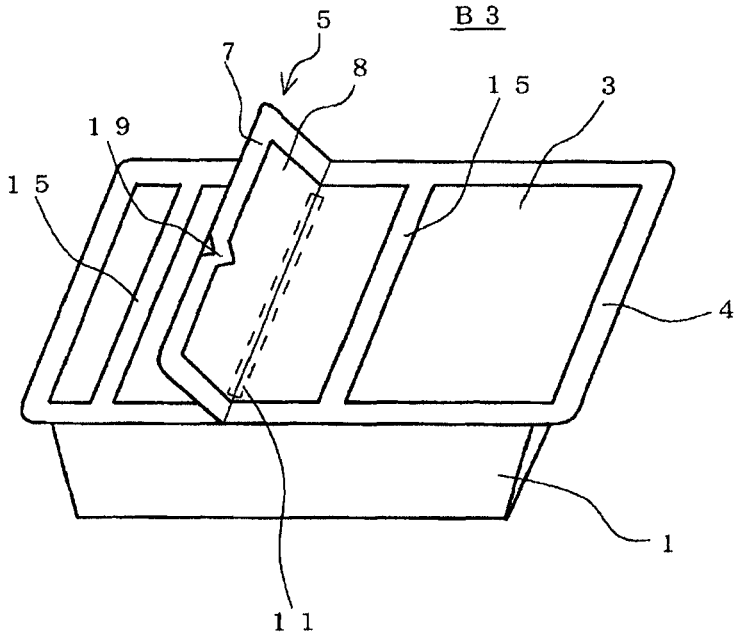
FIG. 9 A diagram showing still another example of the packaging container for cooking by an electronic oven of the present invention.

FIG. 9 shows still another example of the packaging container for cooking by an electronic oven of the present invention.

In the packaging container B3, the upper member 10 and the lower member 12 constituting the cover member 3 are heat-sealed along the full length in the width direction of the cover member 3 at positions 15 and 15 different from the steam guide part 11. The top peripheral seal part 7 of the abutted part 5 of the cover member 3 is projected like letter V toward the inside of the abutted part 5 to form a steam releasing seal part 19. The other constitution of the packaging container B3 is the same as that of the packaging container B1 shown in FIGS. 1 to 4.

In the packaging container B3, the lower member 12 of the cover member 3 is made in a size which is enough to cover the whole under surface of the upper member 10 as shown in FIG. 6. Heat seal parts 15 and 15 extending along the full length in the width direction of the cover member 3 are formed on the inner side of the peripheral seal part 4 of the cover member 3 so that stress by steam or the like generated from the contents is concentrated on the steam releasing seal part 19 formed in the abutted part 5 of the cover member 3 in order to prevent the stress from being applied to the peripheral seal part 4 on both sides parallel to the heat seal parts 15 and 15 when the packaging container B3 is heated by an electronic oven.

Figure 10:
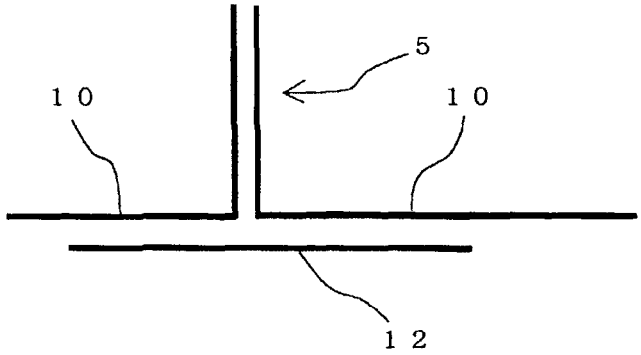
FIG. 10 A schematic diagram describing still another example of the process of manufacturing the cover member of the packaging container for cooking by an electronic oven of the present invention.

In the packaging container B3, the lower member 12 of the cover member 3 is made in a size which is enough to cover the whole under surface of the upper member 10. As shown in the schematic diagram in FIG. 10, the lower member 12 of the cover member 3 may be made in a size which is enough to cover part of the under surface of the upper member 10, and the peripheral part of the lower member 12 may be heat-sealed to the upper member 10 to form the heat seal parts 15 and 15.

Figure 11:
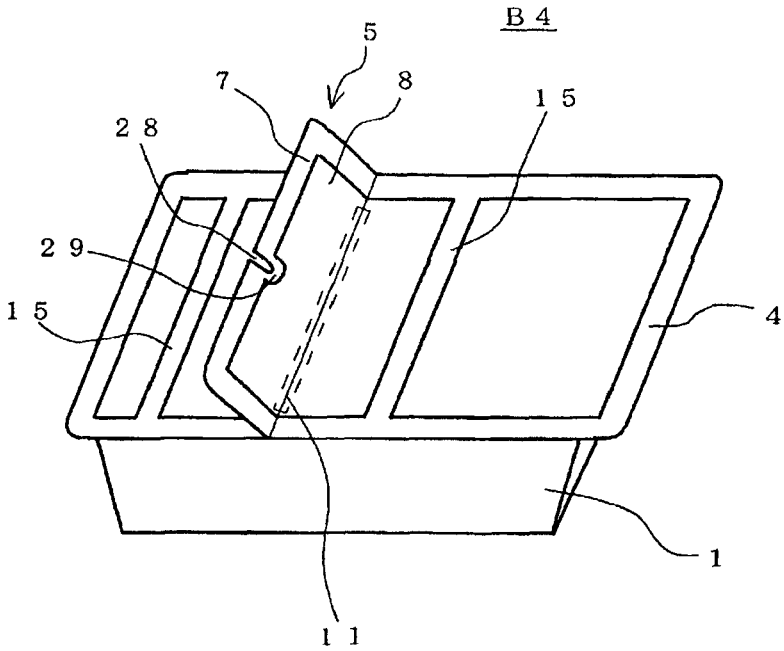
FIG. 11 A diagram showing a further example of the packaging container for cooking by an electronic oven of the present invention.

FIG. 11 shows a further example of the packaging container for cooking by an electronic oven of the present invention.

In the packaging container B4, a U-shaped notch 28 extending toward the inside of the abutted part 5 is formed at the top end of the abutted part 5 of the cover member 3, and the peripheral part of the notch 28 is heat-sealed to form a steam releasing seal part 29. The other constitution of the packaging container B4 is the same as that of the packaging container B3 shown in FIG. 9.

Figure 12:
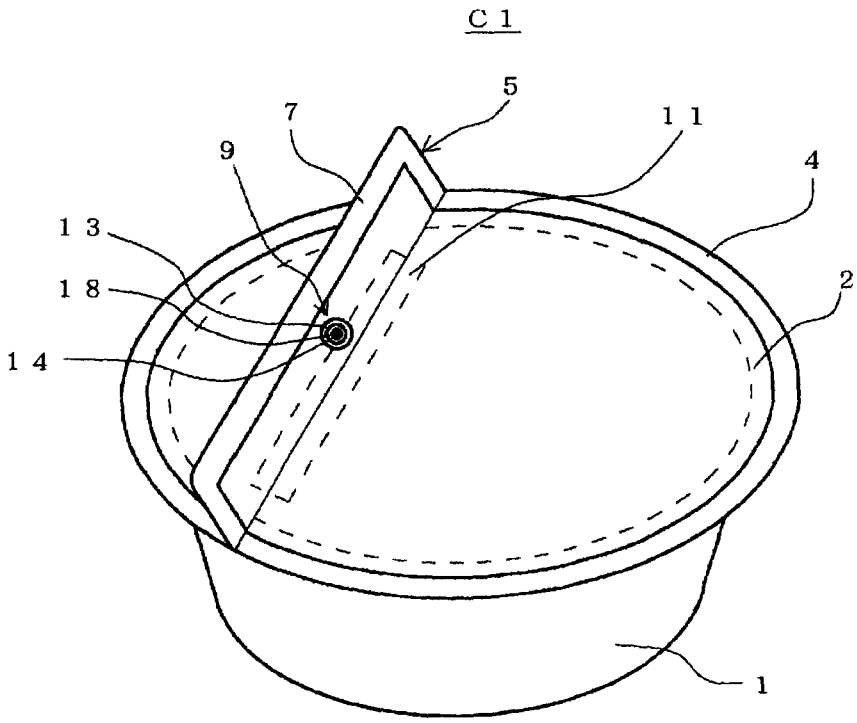
FIG. 12 A diagram showing a still further example of the packaging container for cooking by an electronic oven of the present invention.

FIG. 12 is a perspective view of a still further example of the packaging container for cooking by an electronic oven of the present invention.

In the packaging container C1, the container body 1 is shaped like a cup whose top surface is round and whose diameter decreases gradually toward the bottom. The steam releasing seal part 9 formed in the abutted part 5 of the cover member 3 is located at a position separate from the peripheral seal part 7 like the packaging container B2 shown in FIG. 8. The steam releasing seal part 9 is composed of an annular outer seal part 13, an unsealed part 18 formed on the inner side of the outer seal part 13, and a through hole 14 formed in the unsealed part 18. The other constitution of the packaging container C1 is basically the same as that of the packaging container B2 shown in FIG. 8.

Figure 13:
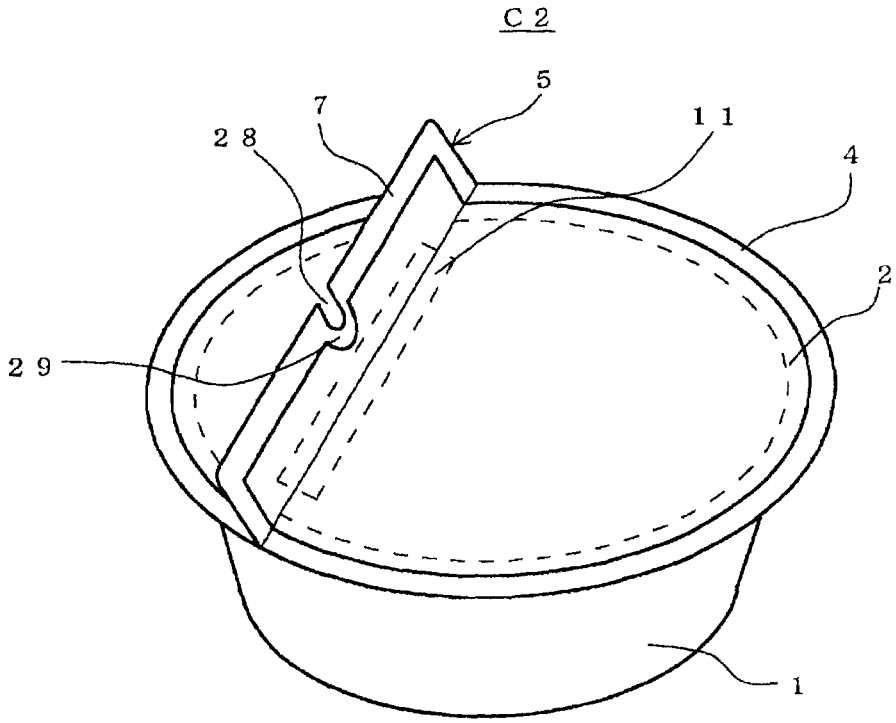
FIG. 13 A diagram showing a still further example of the packaging container for cooking by an electronic oven of the present invention.

FIG. 13 is a perspective view of a still further example of the packaging container for cooking by an electronic oven of the present invention.

In the packaging container C2, a U-shaped notch 28 extending toward the inside of the abutted part 5 is formed at the top end of the abutted part 5 of the cover member 3, and the peripheral part of the U-shaped notch 28 is heat-sealed to form a steam releasing seal part 29. The other constitution of the packaging container C2 is the same as that of the packaging container C1 shown in FIG. 12.

The packaging container body of the present invention can be manufactured by a common method. For example, as a forming method of the container body, vacuum forming, pressure forming, vacuum pressure forming, or injection molding may be used. It is needless to say that the size and shape of the packaging container may be set arbitrarily.

EXAMPLES

The following examples are provided for the purpose of further illustrating the present invention, but the present invention is not limited to the examples.

Example 1

From the exterior side, a silica vapor deposited biaxially-oriented polyester film having a thickness of 12 μm, a biaxially-oriented nylon film having a thickness of 15 μm, and a polypropylene film having a thickness of 50 μm were assembled together by dry lamination using a polyurethane-based adhesive to manufacture a rolled multi-layer film which is used as the upper member of the cover member.

The multi-layer film was set in a bag making machine and the polypropylene layers were faced with each other to form an inner resin layer, thereby forming the abutted part 5 having a height of 20 mm at an A of 15 mm and a B of 120 mm (A/B=0.13) in FIG. 1. The peripheral part of the abutted part excluding one side which becomes the base part of the abutted part was heat-sealed in a seal width of 5 mm to form the unsealed part 8. A 3 mm-wide peripheral seal part of the lower member of the cover member was formed on the outer sides of A and B.

A substantially round outer seal part 13 having a radius of 6 mm was formed continuous with the peripheral seal part 7 at the center of the peripheral seal part 7 of the abutted part 5, and a through hole 14 having a diameter of 2 mm was formed at the center of the outer seal part 13 by using a punch and die to form the steam releasing seal part 9.

Next, slits were formed in the lower member 12 along the almost full length in the width direction at a position corresponding to the base part of the abutted part 5 to form the steam guide part 11. The lower member 12 was composed of a propylene film having a thickness of 50 μm and made in a size which is enough to cover the whole under surface of the above upper member 10. Then, the whole peripheral part of the lower member 12 was heat-sealed to the upper member 10 to manufacture the cover member 3 of the packaging container B1 shown in FIG. 1.

Meanwhile, a square container B1 equipped with a flange shown in FIG. 1 was formed of a 0.8 mm-thick polypropylene resin multi-layer sheet by an ordinary vacuum pressure forming machine. The square container B1 had an outer measurement of 155 mm×133 mm, a height of 29 mm (inner capacity of about 340 ml), a width of 8 mm at a linear part of the flange, and a maximum width of 17 mm at a corner part of the flange. 20 square containers were each filled with 200 g of rice, and the cover member 3 obtained above was heat-sealed to the flange parts 2 to seal up the containers.

Example 2

A cover member and a container body were manufactured in the same manner as in Example 1 except that the upper member 10 of the cover member 3 having an A of 30 mm and a B of 105 mm (A/B=0.29) was used, and 20 square containers each filled with 200 g of rice and sealed up were manufactured likewise.

Example 3

A cover member and a container body were manufactured in the same manner as in Example 1 except that the upper member 10 of the cover member 3 having an A of 55 mm and a B of 80 mm (A/B=0.69) was used, and 20 square containers each filled with 200 g of rice and sealed up were manufactured likewise.

Example 4

A cover member and a container body were manufactured in the same manner as in Example 2 except that a steam releasing seal part 9 was formed at a position separate from the peripheral seal part 7 as shown in FIG. 8, and 20 square containers each filled with 200 g of rice and sealed up were manufactured likewise.

Reference Example 1

A cover member and a container body were manufactured in the same manner as in Example 1 except that the upper member 10 of the cover member 3 having an A of 65 mm and a B of 70 mm (A/B=0.93) was used, and 20 square containers each filled with 200 g of rice and sealed up were manufactured likewise.

Comparative Example 1

A cover member and a container body were manufactured in the same manner as in Example 2 except that the cover member 3 was only composed of an upper member without using the lower member 12, and 20 square containers each filled with 200 g of rice and sealed up were manufactured likewise.

20 containers filled with rice obtained in the above Examples were heated in an electronic oven at a rated output of 600 W to check the condition of automatic opening from the steam releasing seal part and a leak from the peripheral seal part of the container. The results are shown in Table 1.

TABLE 1

| | Abutted part (mm) | | | Heating in electronic oven | |
|---|---|---|---|---|---|
| | A | B | A/B | Number of automatic openings | Number of leaks |
| Example 1 | 15 | 120 | 0.13 | 20/20 | 0/20 |
| Example 2 | 30 | 105 | 0.29 | 20/20 | 0/20 |
| Example 3 | 55 | 80 | 0.69 | 20/20 | 0/20 |
| Example 4 | 30 | 105 | 0.29 | 20/20 | 0/20 |
| Reference Example 1 | 65 | 70 | 0.93 | 13/20 | 7/20 |
| Comparative Example 1 | 30 | 105 | 0.29 | 1/20 | 19/20 |

According to Table 1 above, in the packaging container for cooking by an electronic oven of the present invention in which the cover member was formed of (1) an upper member having an abutted part with a steam releasing seal part and (2) a lower member which covers the under surface of the upper member and has a steam guide part below the abutted part of the upper member, a leak of the contents from the peripheral seal part could be prevented as the container automatically opened from the steam releasing seal part when the container was heated in an electronic oven. The containers of Examples 1 to 4 in which the abutted part of the above upper member was set to ensure that A/B becomes 0.1 to 0.8 automatically opened from the steam releasing seal part and a leak of the contents from the peripheral seal part was not seen at all.

In contrast to this, in some of the containers of Reference Example 1 in which A/B is outside the above range, the contents leaked out from the peripheral seal part. In most of the containers of Comparative Example 1 in which the lower member is not used, the contents leaked out from the seal part between the base part of the abutted part of the cover member and the flange part.

The invention claimed is:

1. A packaging container for cooking by an electronic oven, comprising: a container body having a flange part and made of a synthetic resin; and a cover member which is heat-sealed to the flange part of the container body, the cover member comprising, (1) an upper member comprising an abutted part formed by heat-sealing inner surfaces of resin films that are opposed to each other, an unsealed part formed by heat-sealing a peripheral part of the abutted part excluding one side forming a base part of the abutted part, and a steam releasing seal part formed in the abutted part; and (2) a lower member which covers at least an under surface of the base part of the abutted part of the upper member and has a steam guide part through which the unsealed part of the upper member is in communication with the inside of the container body at or near the base part of the abutted part.

2. The packaging container for cooking by the electronic oven according to claim 1, wherein the resin film constituting the upper member of the cover member is composed of a multi-layer film including at least an inner resin layer having heat sealability and an outer resin layer.

3. The packaging container for cooking by the electronic oven according to claim 1, wherein the lower member of the cover member covers the whole under surface of the upper member of the cover member.

4. The packaging container for cooking by the electronic oven according to claim 1, wherein the upper member and lower member constituting the cover member are heat-sealed along the full length in the width direction of the cover member at positions other than the steam guide part.

5. The packaging container for cooking by the electronic oven according to claim 1, wherein the upper member of the cover member is formed by bending the end parts of two resin films, abutting the bent parts against each other, and heat-sealing the peripheral part of the abutted part.

6. The packaging container for cooking by the electronic oven according to claim 1, wherein the upper member of the cover member is formed by folding one resin film to form a mountain part arid heat-sealing a peripheral part of the mountain part.

7. The packaging container for cooking by the electronic oven according to claim 1, wherein the steam releasing seal part is formed by projecting a top heat seal part of the abutted part formed in the upper member of the cover member toward the inside of the abutted part.

8. The packaging container for cooking by the electronic oven according to claim 1, wherein the steam releasing seal part is formed by forming a notch extending toward the inside of the abutted part at a top-edge of the abutted part formed in the upper member of the cover member and heat-sealing a peripheral part of the notch.

9. The packaging container for cooking by the electronic oven according to claim 1, wherein the steam releasing seal part is formed by forming a heat seal part having a weak part in the abutted part at a position separate from the top edge heat seal part of the abutted part formed in the upper member of the cover member.

10. The packaging container for cooking by the electronic oven according to claim 9, wherein the steam releasing seal part is composed of an annular outer seal part, an unsealed part formed on the inner side of the outer seal part and a weak part composed of a through hole or a slit formed in the unsealed part.

11. The packaging container for cooking by the electronic oven according to claim 1, wherein a top surface of the container body and the cover member are each made in a square shape, when the length from one inner end of the top surface of the container body to the base part of the abutted part of the cover member is represented by A, and the distance between the base part of the abutted part and the other inner end of the top surface of the container body is represented by B, A/B is 0.1 to 0.8.

12. The packaging container for cooking by the electronic oven according to claim 1, wherein the lower member is molten and filled into the base part of the abutted part at the flange part of the container body so as to leave no space constituting the unsealed part communicating with the inside of the container body.

* * * * *